US007034240B1

(12) United States Patent
Wang

(10) Patent No.: US 7,034,240 B1
(45) Date of Patent: Apr. 25, 2006

(54) CONTROLLING APPARATUS FOR ELECTRIC TOOL

(75) Inventor: Guan-Jiun Wang, Taichung Hsien (TW)

(73) Assignee: Yeou Yeng Industry Co. Ltd., Wu Feng Hsiang (TW)

( * ) Notice: Subject to any disclaimer, the term of this patent is extended or adjusted under 35 U.S.C. 154(b) by 0 days.

(21) Appl. No.: 11/024,509

(22) Filed: Dec. 29, 2004

(51) Int. Cl.
*H01H 13/68* (2006.01)

(52) U.S. Cl. ..... 200/518; 200/341

(58) Field of Classification Search ..... 200/518–522, 200/341, 332.2, 61.39, 61.85, 43.17, 1 V
See application file for complete search history.

(56) References Cited

U.S. PATENT DOCUMENTS

| | | | | |
|---|---|---|---|---|
| 4,351,581 | A * | 9/1982 | Wied | 439/713 |
| 4,678,871 | A * | 7/1987 | Wong | 200/1 V |
| 5,170,851 | A * | 12/1992 | Kress et al. | 173/29 |
| 6,489,578 | B1 * | 12/2002 | Jung et al. | 200/332.2 |
| 6,555,775 | B1 * | 4/2003 | Van Bokhoven et al. | 200/522 |

FOREIGN PATENT DOCUMENTS

| | | |
|---|---|---|
| TW | 494835 | 7/2002 |

* cited by examiner

*Primary Examiner*—Elvin G. Enad
*Assistant Examiner*—Lisa Klaus
(74) *Attorney, Agent, or Firm*—Alan D. Kamrath; Nikolai & Mersereau, P.A.

(57) ABSTRACT

An electric tool includes a power supply, a controlling apparatus and a two-way motor. The motor includes first and second leads. The controlling apparatus includes a first conductive element connected with the anode of the power supply, a second conductive element connected with the cathode of the power supply, a switching device comprising a carrier for carrying and switching the conductive elements between a neutral position, a first operative position and a second operative position. In the neutral position, the conductive elements do not contact the leads of the motor. In the first operative position, the first end of the first conductive element contacts the first lead of the motor and the second end of the second conductive element contacts the second lead of the motor. In the second operative position, the second end of the first conductive element contacts the second lead of the motor and the first end of the second conductive element contacts the first lead of the motor.

11 Claims, 7 Drawing Sheets

CONTROLLING APPARATUS FOR ELECTRIC TOOL

BACKGROUND OF INVENTION

1. Field of Invention

The present invention relates to an electric tool and, more particularly, to a controlling apparatus for an electric tool.

2. Related Prior Art

According to Taiwanese Patent Publication No. 494835, a conventional electric tool includes a power supply 13, a two-way motor 40, two conductors 34 for connecting the power supply 13 with the two-way motor 40, a first housing 10 for housing the power supply 13, a second housing 20 for housing the two-way motor 40 and a switch 30 for switching the conductors 34. The switch 30 includes a cylindrical wall and a partition 31 formed on an internal side of the cylindrical wall so that the cylindrical wall is separated into a lower section and an upper section. The partition 31 defines an aperture 310, two radial slots 311, two arched slots 312 each communicated with a related radial slot 311 and four arched slots 35. The housing 10 includes a connecting portion 14, four tabs 141 formed on the connecting portion 14, a shaft 142 formed on the connecting portion 14 and two apertures 143 defined in the connecting portion 14. A first contact 15 is inserted through one of the apertures 143, and a second contact 15 is inserted through the other aperture 143. The connecting portion 14 of the first housing 10 is put in the lower section of the cylindrical wall of the switch 30. Each tab 141 is inserted in a related arched slot 35. The shaft 142 is inserted in the aperture 310. The connecting portion 14 of the first housing 10 is connected with a connecting portion 21 of the second housing 20 by screws 16. The first contact 15 contacts a first electrode of the power supply 13 on one hand and contacts the first conductor 34 on the other hand. The second contact 15 contacts a second electrode of the power supply 13 on one hand and contacts the second conductor 34 on the other hand. The two-way motor 40 includes first and second leads 42. As the leads 42 do not contact the conductors 34, the two-way motor 40 is off. To cause the two-way motor 40 to operate in a direction, the switch 30 is turned in a direction so that the first conductor 34 contacts the first lead 42 and that the second conductor 34 contacts the second lead 42. To cause the two-way motor 40 to operate in an opposite direction, the switch 30 is turned in an opposite direction so that the first conductor 34 contacts the second lead 42 and that the second conductor 34 contacts the first lead 42. This conventional electric tool is, however, complicated in structure, difficult in fabrication and high in cost.

The present invention is therefore intended to obviate or at least alleviate the problems encountered in the prior art.

SUMMARY OF INVENTION

According to the present invention, a controlling apparatus is disclosed for an electric tool. The electric tool includes a power supply and a two-way motor. The motor includes first and second leads. The controlling apparatus includes a first conductive element connected with the anode of the power supply, a second conductive element connected with the cathode of the power supply, a switching device comprising a carrier for carrying and switching the conductive elements between a neutral position, a first operative position and a second operative position. In the neutral position, the conductive elements do not contact the leads of the motor. In the first operative position, the first end of the first conductive element contacts the first lead of the motor and the second end of the second conductive element contacts the second lead of the motor. In the second operative position, the second end of the first conductive element contacts the second lead of the motor and the first end of the second conductive element contacts the first lead of the motor.

The primary advantage of the present invention is to provide a structurally simple controlling apparatus for an electric tool.

Other objects, advantages, and novel features of the invention will become more apparent from the following detailed description when taken in conjunction with the drawings.

BRIEF DESCRIPTION OF DRAWINGS

The present invention will be described through detailed illustration of the preferred embodiment referring to the drawings.

DETAILED DESCRIPTION OF PREFERRED EMBODIMENT

Figure 1:
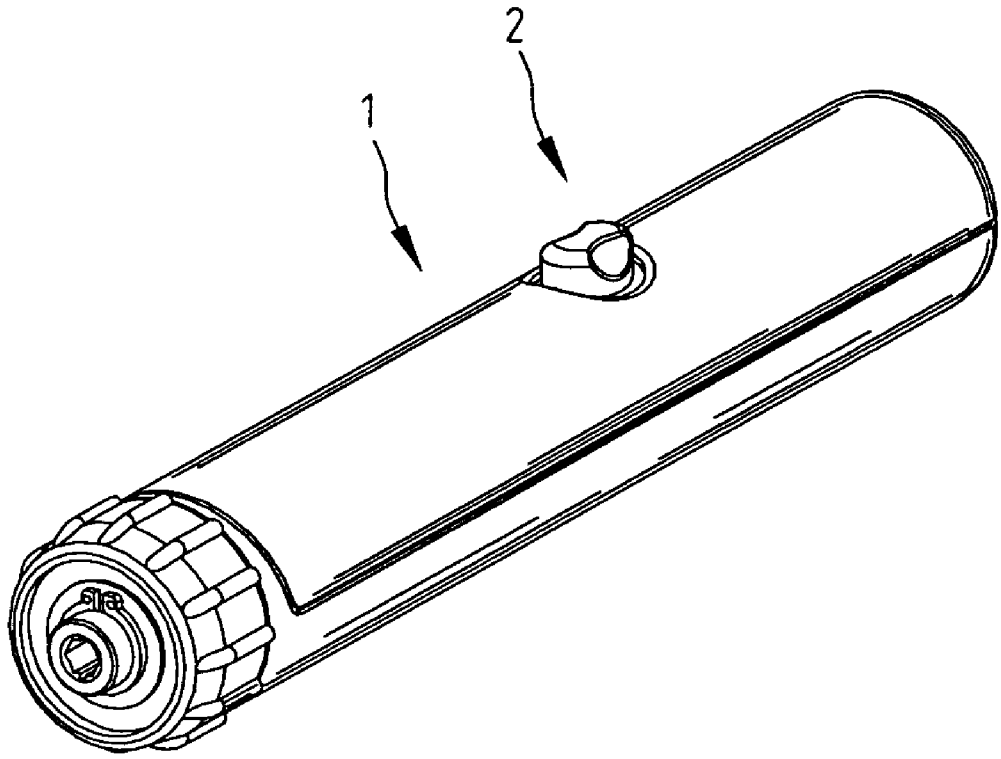
FIG. 1 is a perspective view of an electric tool according to the preferred embodiment of the present invention.
Figure 2:
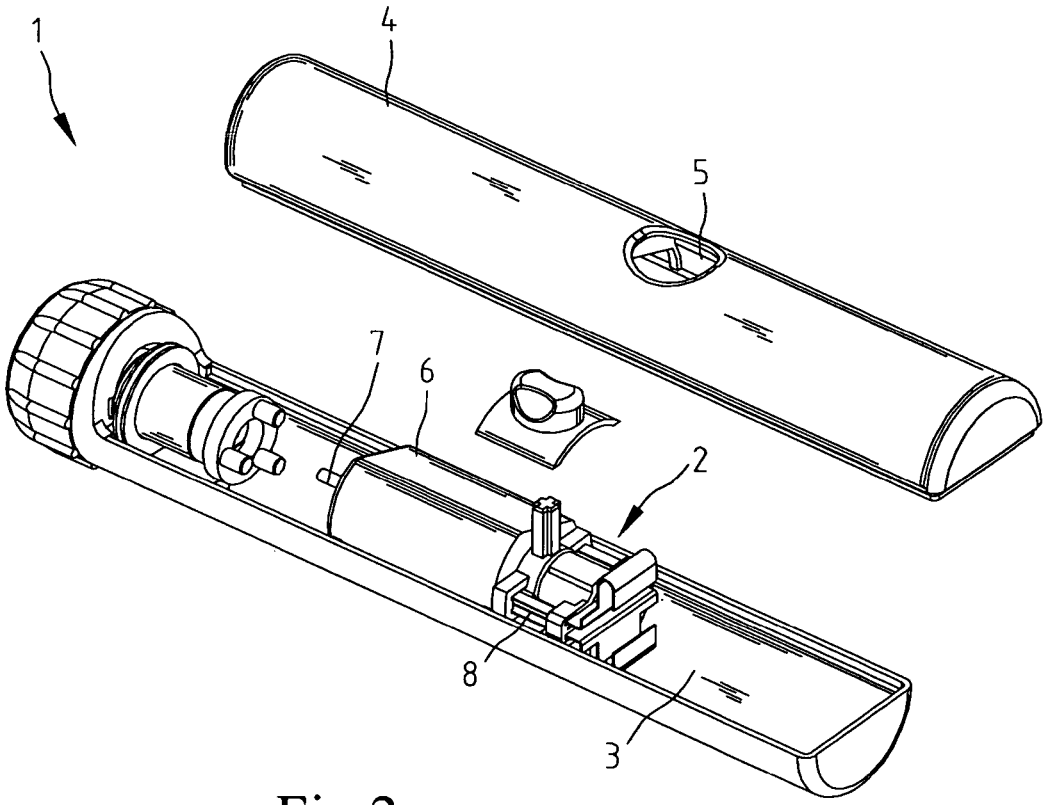
FIG. 2 is an exploded view of the electric tool shown in FIG. 1.
Figure 3:
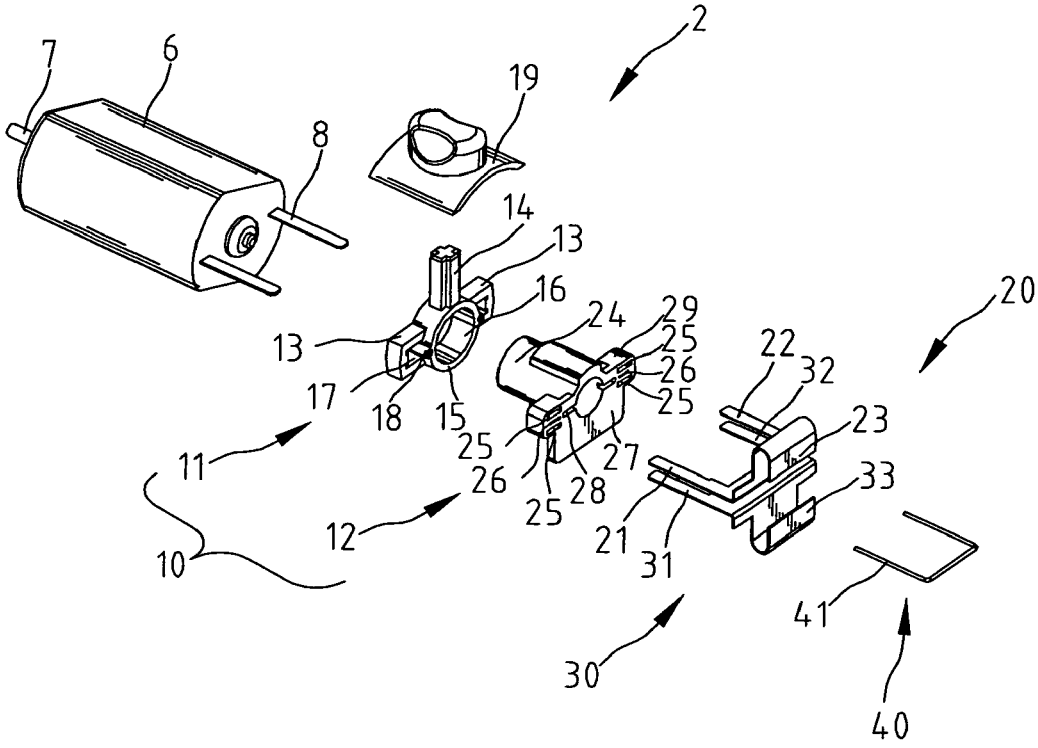
FIG. 3 is an exploded view of a controlling apparatus for the electric tool of FIG. 2.
Figure 4:
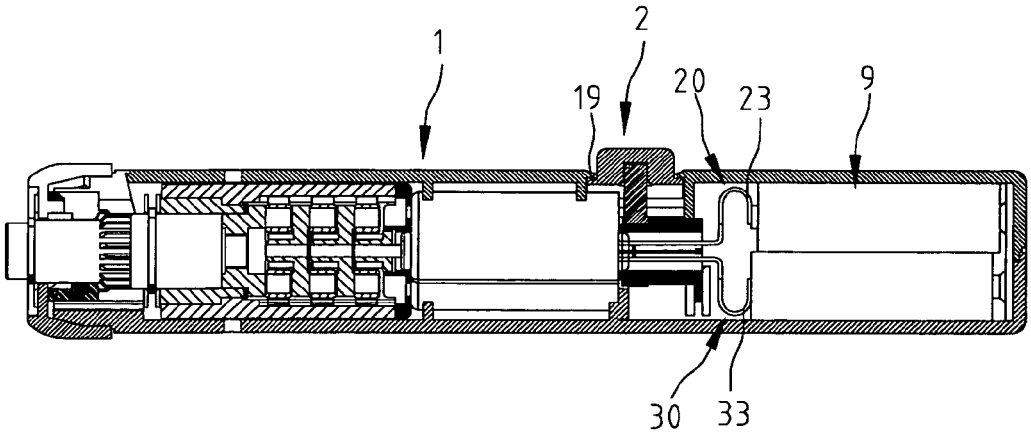
FIG. 4 is a cross-sectional view of the electric tool of FIG. 1.

Referring to FIGS. 1 to 4, according to the preferred embodiment of the present invention, the electric tool 1 includes a handle for containing a power supply, a two-way motor 6 installed in the handle and a controlling apparatus 2 installed in the handle between the power supply and the two-way motor 6.

The handle consists of a shell 3 and a cover 4. The cover 4 defines an opening 5.

The two-way motor 6 is installed in the handle. The two-way motor 6 includes a mandrel 7, a first lead 8 and a second lead 8.

The controlling apparatus 2 includes a first conductive element 20 for contact with a first electrode of the power supply, a second conductive element 30 for contact with a second electrode of the power supply and a switching device 10 for switching the conductive elements 20 and 30.

The switching device 10 includes a carrier 12 for carrying the conductive elements 20 and 30 and a driver 11 for turning the carrier 12.

The carrier 12 includes a cylinder 24, a tab 27 extending from the cylinder 24 and two wings 29 extending from the tab 27. The tab 27 defines two apertures 28. Each wing 29 includes two apertures 25 and an aperture 26 located between the apertures 25.

The driver 11 includes a ring 15, a rod 14 extending from the ring 15 and first and second wings 13 extending from the ring 15. Each wing 13 defines an aperture 17. A tube 18 is raised from each wing 13. The ring 15 includes a bore 16 for receiving the cylinder 24 of the carrier 12.

A switch 19 includes an end extending through the opening 5 and an opposite end mounted on the rod 14 of the driver 11 so that the switch 19 can be operated in order to turn the driver 11 in two opposite directions.

The first conductive element 20 includes a first end 21, a second end 22 and a contact 23 formed between the ends 21.

The second conductive element 30 includes a first end 31, a second end 32 and a contact 33 formed between the ends 31 and 32.

The power supply includes two batteries 9 each including an anode and a cathode. The batteries 9 are installed in the handle. The batteries 9 are connected in series. The anode of one of the batteries 9 is in contact with the first conductive element 20. The cathode of the other battery 9 is in contact with the second conductive element 30.

A connecting element 40 includes two feet 41. The feet 41 are inserted in the tubes 18 through the apertures 28 in order to connect the carrier 12 with the driver 11.

In assembly, the ends 21 and 22 of the first conductive element 20 and the ends 31 and 32 of the second conductive element 30 are inserted in the apertures 17 through the apertures 25. The first lead 8 of the two-way motor 6 is inserted in the aperture 17 of the first wing 13. The second lead 8 of the two-way motor 6 is inserted into the aperture 17 of the second wing 13.

Figure 5:
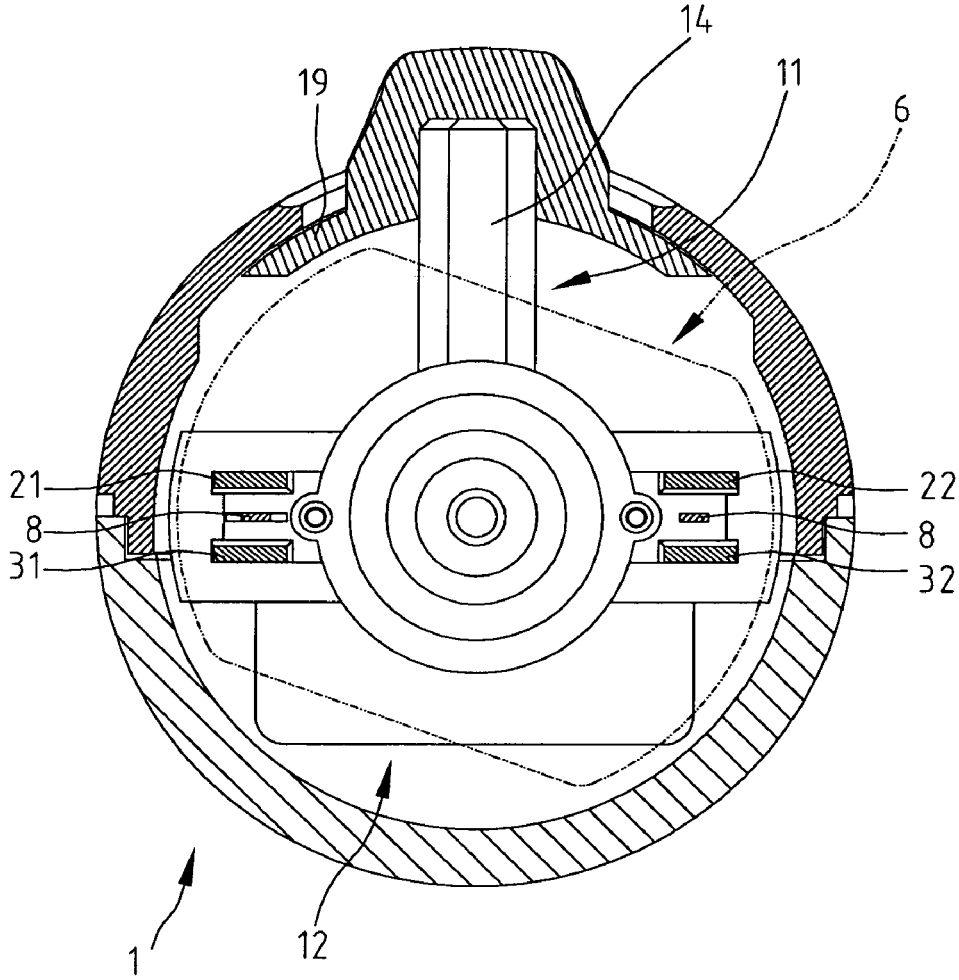
FIG. 5 is a cross-sectional view of the electric tool of FIG. 1 and shows the electric tool in an idle mode.

FIG. 5 shows the controlling apparatus 2 for the electric tool in an idle mode. The switch 19 is in a neutral position so that it does not bring the first conductive element 20 or the second conductive element 30 into contact with the first lead 8 or the second lead 8. Thus, the two-way motor 6 is off.

Figure 6:
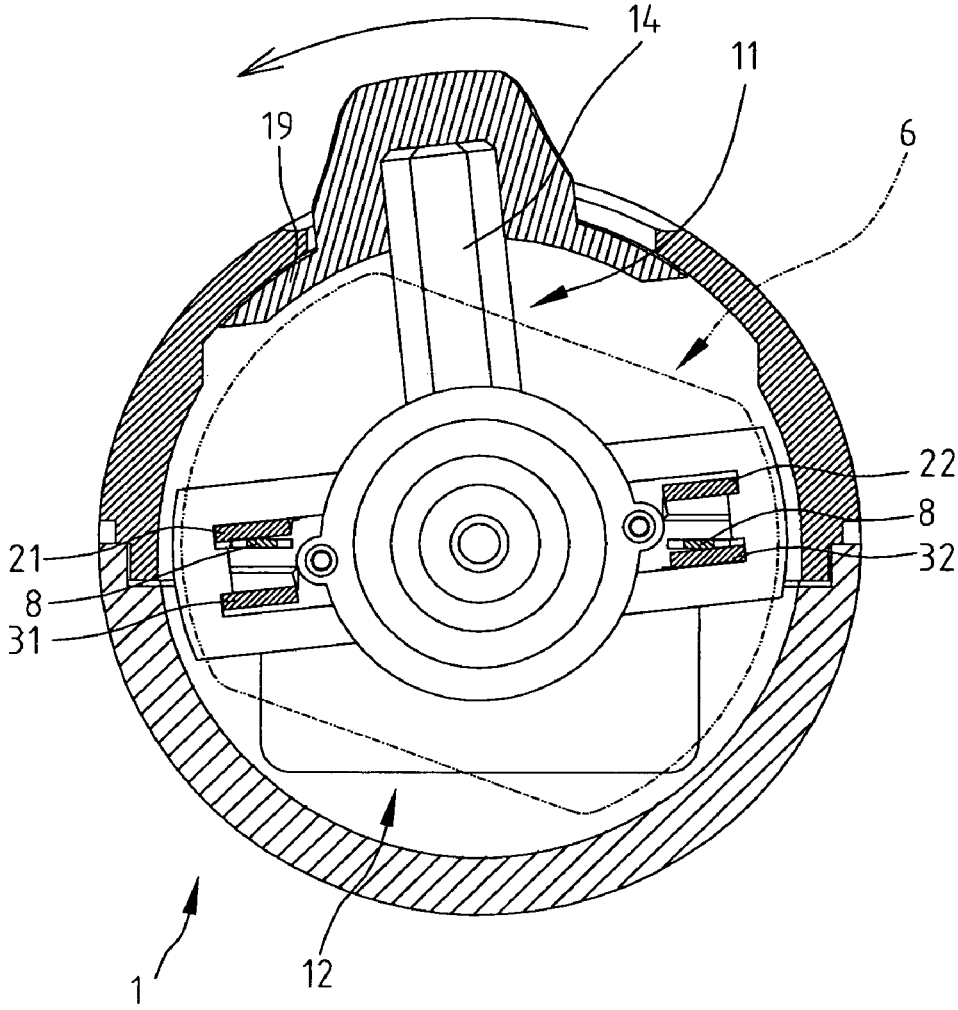
FIG. 6 is similar to FIG. 5 but shows the electric tool for operation in a first direction.

FIG. 6 shows the the electric tool for operation in a first direction. When the switch 19 is turned in a first direction, the rod 14 is turned accordingly. Thus, the switch 19 brings the first end 21 of the first conductive element 20 into contact with the first lead 8 of the two-way motor 6, and brings the second end 32 of the second conductive element 30 into contact with the second lead 8 of the two-way motor 6. Thus, the two-way motor 6 is operated in a first direction.

Figure 7:
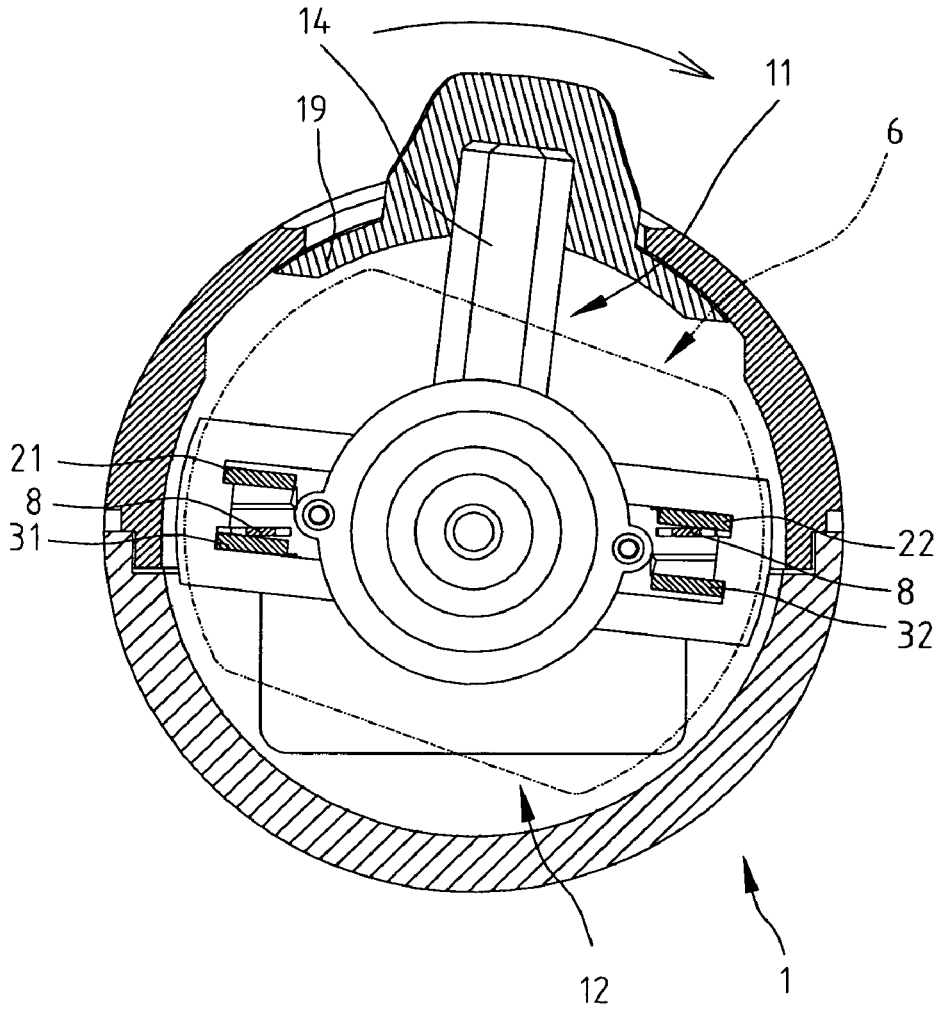
FIG. 7 is similar to FIG. 6 but shows the electric tool for operation in an opposite direction.

FIG. 7 shows the electric tool for operation in a second direction opposite to the first direction. When the switch 19 is turned in a second direction, the rod 14 is turned accordingly. Thus, the switch 19 brings the first end 31 of the second conductive element 30 into contact with the first lead 8 of the two-way motor 6, and brings the second end 22 of the first conductive element 20 into contact with the second lead 8 of the two-way motor 6. Thus, the two-way motor 6 is operated in the second direction.

The present invention has been described through detailed illustration of the preferred embodiment. Those skilled in the art can derive variation from the preferred embodiment without departing from the scope of the present invention. Therefore, the preferred embodiment shall not limit the scope of the present invention defined in the claims.

What is claimed is:

1. A controlling apparatus for an electric tool, the electric tool comprising a power supply and a two-way motor, the motor comprising a first lead and a second lead, the controlling apparatus comprising:

a first conductive element connected with the anode of the power supply, the first conductive element comprising a first end for contacting the leads of the motor and a second end for contacting the leads of the motor;

a second conductive element connected with the cathode of the power supply, the second conductive element comprising a first end for contacting the leads of the motor and a second end for contacting the leads of the motor; and a switching device comprising a carrier for carrying and switching the conductive elements between a neutral position, a first operative position and a second operative position;

wherein the conductive elements do not contact the leads of the motor in the neutral position;

wherein the first end of the first conductive element contacts the first lead of the motor and the second end of the second conductive element contacts the second lead of the motor in the first operative position;

wherein the second end of the first conductive element contacts the second lead of the motor and the first end of the second conductive element contacts the first lead of the motor in the second operative position;

wherein the carrier comprises four slots for receiving the ends of the conductive elements.

2. The controlling apparatus according to claim 1 wherein the second conductive element comprises a contact formed between the ends for contacting the cathode of the power supply.

3. The controlling apparatus according to claim 1 wherein the switching device comprises a driver operable for turning the carrier.

4. The controlling apparatus according to claim 3 wherein the carrier comprises a cylinder formed thereon, wherein the driver comprises a ring installed on the cylinder.

5. The controlling apparatus according to claim 1 wherein the power supply comprises batteries.

6. A controlling apparatus for an electric tool, the electric tool comprising a power supply and a two-way motor, the motor comprising a first lead and a second lead, the controlling apparatus comprising:

a first conductive element connected with the anode of the power supply, the first conductive element comprising a first end for contacting the leads of the motor and a second end for contacting the leads of the motor;

a second conductive element connected with the cathode of the power supply, the second conductive element comprising a first end for contacting the leads of the motor and a second end for contacting the leads of the motor; and a switching device comprising a carrier for carrying and switching the conductive elements between a neutral position, a first operative position and a second operative position;

wherein the conductive elements do not contact the leads of the motor in the neutral position;

wherein the first end of the first conductive element contacts the first lead of the motor and the second end of the second conductive element contacts the second lead of the motor in the first operative position;

wherein the second end of the first conductive element contacts the second lead of the motor and the first end of the second conductive element contacts the first lead of the motor in the second operative position;

wherein the switching device comprises a driver operable for turning the carrier;

wherein the driver comprises a rod extending from the ring for easy operation of the driver.

7. The controlling apparatus according to claim 6 wherein the first conductive element comprises a contact formed between the ends for contacting the anode of the power supply.

8. The controlling apparatus according to claim 6 comprising a switch installed on the rod of the driver.

9. A controlling apparatus for an electric tool, the electric tool comprising a power supply and a two-way motor, the motor comprising a first lead and a second lead, the controlling apparatus comprising:

a first conductive element connected with the anode of the power supply, the first conductive element comprising a first end for contacting the leads of the motor and a second end for contacting the leads of the motor;

a second conductive element connected with the cathode of the power supply, the second conductive element comprising a first end for contacting the leads of the motor and a second end for contacting the leads of the motor; and a switching device comprising a carrier for carrying and switching the conductive elements between a neutral position, a first operative position and a second operative position;

wherein the conductive elements do not contact the leads of the motor in the neutral position;

wherein the first end of the first conductive element contacts the first lead of the motor and the second end of the second conductive element contacts the second lead of the motor in the first operative position;

wherein the second end of the first conductive element contacts the second lead of the motor and the first end of the second conductive element contacts the first lead of the motor in the second operative position;

wherein the switching device comprises a driver operable for turning the carrier;

wherein the driver comprises two wings each defining an aperture for receiving corresponding one of the leads of the motor.

10. The controlling apparatus according to claim 9 comprising a connecting element for connecting the carrier with the driver.

11. The controlling apparatus according to claim 10 wherein the connecting element comprises two feet formed thereon, wherein the driver comprises two tubes each extending from the ring thereof, wherein the carrier comprises two apertures defined therein so that each of the feet of the connecting element is inserted into corresponding one of the tubes through corresponding one of the apertures.

* * * * *